US005281085A

United States Patent [19]

Lenahan et al.

[11] Patent Number: 5,281,085

[45] Date of Patent: Jan. 25, 1994

[54] CLEARANCE CONTROL SYSTEM FOR SEPARATELY EXPANDING OR CONTRACTING INDIVIDUAL PORTIONS OF AN ANNULAR SHROUD

[75] Inventors: Dean T. Lenahan; L. D. Shotts, both of Cincinnati; Bandadi S. Shetty, West Chester; Jeffrey Glover, Cincinnati, all of Ohio

[73] Assignee: General Electric Company, Cincinnati, Ohio

[21] Appl. No.: 631,512

[22] Filed: Dec. 21, 1990

[51] Int. Cl.[5] ..... F01D 9/00

[52] U.S. Cl. ..... 415/116; 415/173.2; 415/178

[58] Field of Search ..... 415/115, 116, 173.1, 415/173.2, 177, 178

[56] References Cited

U.S. PATENT DOCUMENTS

| | | | |
|---|---|---|---|
| 1,678,065 | 7/1928 | Lamb . | |
| 1,678,066 | 7/1928 | Lamb | 415/116 |
| 1,734,216 | 11/1929 | Lamb . | |
| 2,402,841 | 6/1946 | Ray . | |
| 3,029,064 | 4/1962 | Buckingham . | |
| 4,023,731 | 5/1977 | Patterson . | |
| 4,069,662 | 1/1978 | Redinger, Jr. et al. . | |
| 4,213,296 | 7/1980 | Schwarz . | |
| 4,268,221 | 5/1981 | Monsarrat et al. | 415/116 |
| 4,305,697 | 12/1981 | Cohen et al. . | |
| 4,329,114 | 5/1982 | Johnston et al. . | |
| 4,332,133 | 6/1982 | Schwarz et al. . | |
| 4,363,599 | 12/1982 | Cline et al. . | |
| 4,388,124 | 6/1983 | Henry . | |
| 4,522,559 | 6/1985 | Burge et al. | 415/177 |
| 4,553,901 | 11/1985 | Laurello | 415/178 |
| 4,826,397 | 5/1989 | Shook et al. | 415/178 |
| 5,100,291 | 3/1992 | Glover | 415/177 |

FOREIGN PATENT DOCUMENTS

| | | | |
|---|---|---|---|
| 188724 | 7/1986 | European Pat. Off. . | |
| 423025A1 | 4/1991 | European Pat. Off. . | |
| 0718703 | 1/1932 | France | 415/177 |
| 0054672 | 4/1980 | Japan | 415/116 |
| 1248198 | 9/1971 | United Kingdom . | |
| 2117842 | 10/1983 | United Kingdom | 415/116 |

*Primary Examiner*—Edward K. Look
*Assistant Examiner*—Christopher Verdier
*Attorney, Agent, or Firm*—Jerome C. Squillaro; James P. Davidson

[57] ABSTRACT

Improved operation can be achieved from an enhanced gas turbine engine having a segmented annular shroud which radially expands and contracts to match the expansion and contraction of engine rotor blades. The segmented annular shroud is supported by a structure which includes an annular ring having two radially outwardly extending flanges, and forward and aft annular segmented brackets which attach the segmented shroud to the forward and aft side of the ring respectively. In a preferred embodiment of the invention, two circumferentially extending separate and distinct air impingement manifolds surrounds each of the outwardly extending flanges. Each manifold is provided with a valve for controlling the amount and temperature of the airflow entering each manifold. The air from each manifold then impinges upon each of the outwardly extending flanges, thereby controlling the radial movement of the corresponding shroud segments and the associated clearances with the rotor blade tips. The use of separate and distinct manifolds and the corresponding values which regulate the amount and temperature of airflow to each manifold allows individual shroud portions to be separately expanded or contracted.

9 Claims, 2 Drawing Sheets

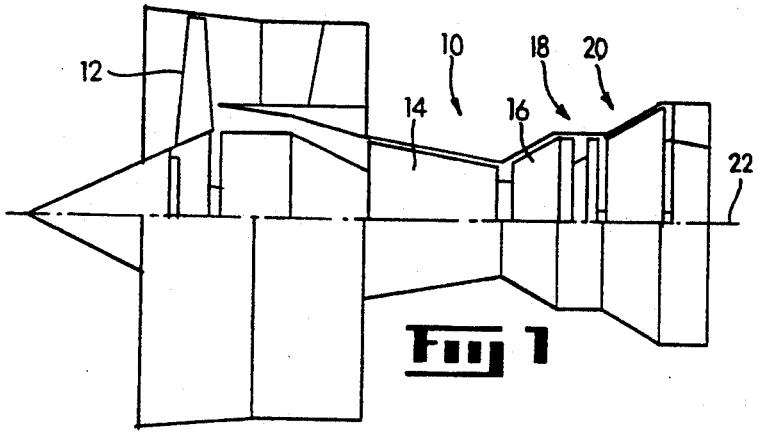
Fig 1
Fig 2
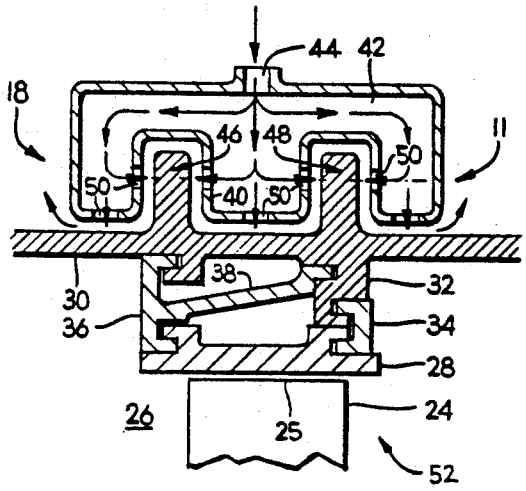
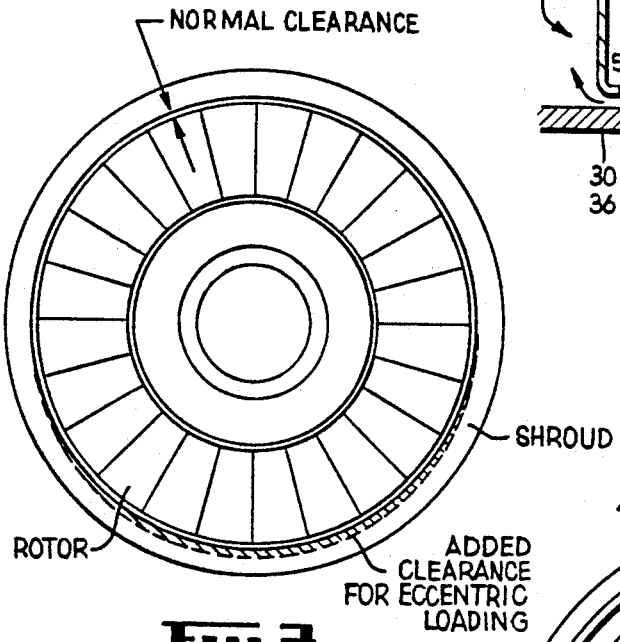
Fig 3
PRIOR ART
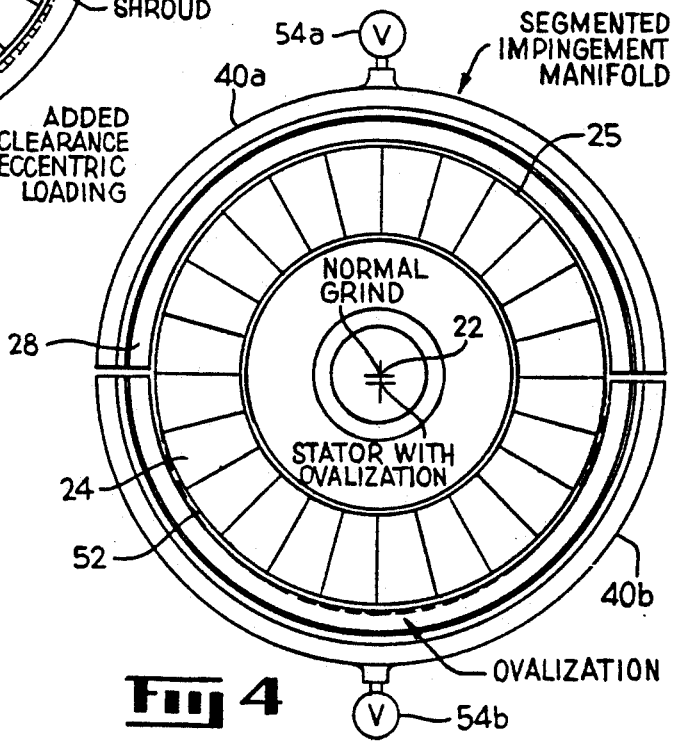
Fig 4

CLEARANCE CONTROL SYSTEM FOR SEPARATELY EXPANDING OR CONTRACTING INDIVIDUAL PORTIONS OF AN ANNULAR SHROUD

The present invention is directed to improvements in gas turbine engines and, more particularly, to improved means for controlling clearance between a rotor and a surrounding shroud.

BACKGROUND OF THE INVENTION

In an effort to maintain a high degree of efficiency, manufacturers of turbine engines have strived to maintain the closest possible clearance between a rotor blade tip and the surrounding stationary shroud structure, because any gas which passes therebetween represents a loss of energy to the system. If a system were to operate only under steady-state maximum power conditions, it would be a simple matter to establish the desired close clearance relationship between the rotor blades and the surrounding stationary shroud. However, in reality, all turbine engines must initially be brought from a standstill condition up to steady-stat speed and then eventually decelerate to the standstill condition.

This transitional operation is not completed with the ideal low clearance condition just described. The problems in maintaining the desired clearance between the rotor and shrouds under these transitional conditions are caused by first, the mechanical expansion and shrinkage of the rotating rotor disk and blades as brought about by changes in speed, and secondly, by the relative thermal growth between the rotating rotor and surrounding stationary shroud support structure caused by differences in thermal expansion between the two structures. One commonly used method of decreasing the tip clearance between the rotor blades and the surrounding shroud has been to direct and modulate variable temperature air or variable cooling airflow rates along the entire outer circumference of the stationary shroud support structure. In this method, the air is directed on the turbine section during appropriate stages of engine operation to change the radial growth or shrinkage rate of the entire turbine shroud support in an effort to match the growth or shrinkage of the rotating turbine parts.

However, additional problems occur during an aircraft maneuver, such as during takeoff and landing. During these maneuvers, engine loadings develop that become eccentric to the engine centerline. One common method of minimizing the clearance effects of eccentric loadings is to eccentrically grind the stationary surrounding shroud, as is shown in FIG. 3. However, this method results in additional airflow leakage around the rotor blades during steady-state, low maneuver load conditions as a result of the added clearance between the rotor blades and a portion of the surrounding shroud.

OBJECTS OF THE INVENTION

It is an object of the present invention to provide an improved gas turbine engine which is capable of transitioning between various aircraft flight conditions while maintaining an allowable clearance between its rotor and the surrounding shroud.

Another object of this invention is to provide a gas turbine engine capable of operating over a variety of engine and aircraft maneuvers without attendant interference between the rotor and any portion of the surrounding stationary shroud.

Still another object of this invention is to provide a system for use in a gas turbine engine capable of continually regulating the clearance between rotor blades and circumferential sections of the surrounding shroud.

SUMMARY OF THE INVENTION

According to one form of the present invention, a new and approved clearance control system comprising a rotor, a shroud and a means to expand or contract individual portions of the shroud. In a preferred embodiment of the invention, the means varies the shape of the shroud to conform to build-up and high load induced nonconcentricities of the rotor.

These and other objects of the invention, together with the features and advantages thereof, will become apparent from the following detailed specification when read in conjunction with the accompanying drawings in which applicable reference numerals have been carried forward.

BRIEF DESCRIPTION OF THE DRAWINGS

The invention, together with further objects and advantages thereof, is more particularly described in the following detailed description taken in conjunction with the accompanying drawings in which:

FIG. 1 is an illustration of a diagrammatic cross-sectional view of a gas turbine engine embodying the present invention.

FIG. 2 is an illustration of a diagrammatic cross-sectional view illustrating in more detail the new and improved clearance control system.

FIG. 3 is a schematic view of the prior art eccentrically ground rotor and shroud structure.

FIG. 4 is an illustration of a schematic view of the new and improved clearance control system having two separate and distinct air impingement manifolds.

DETAILED DESCRIPTION OF THE INVENTION

Figure 5:
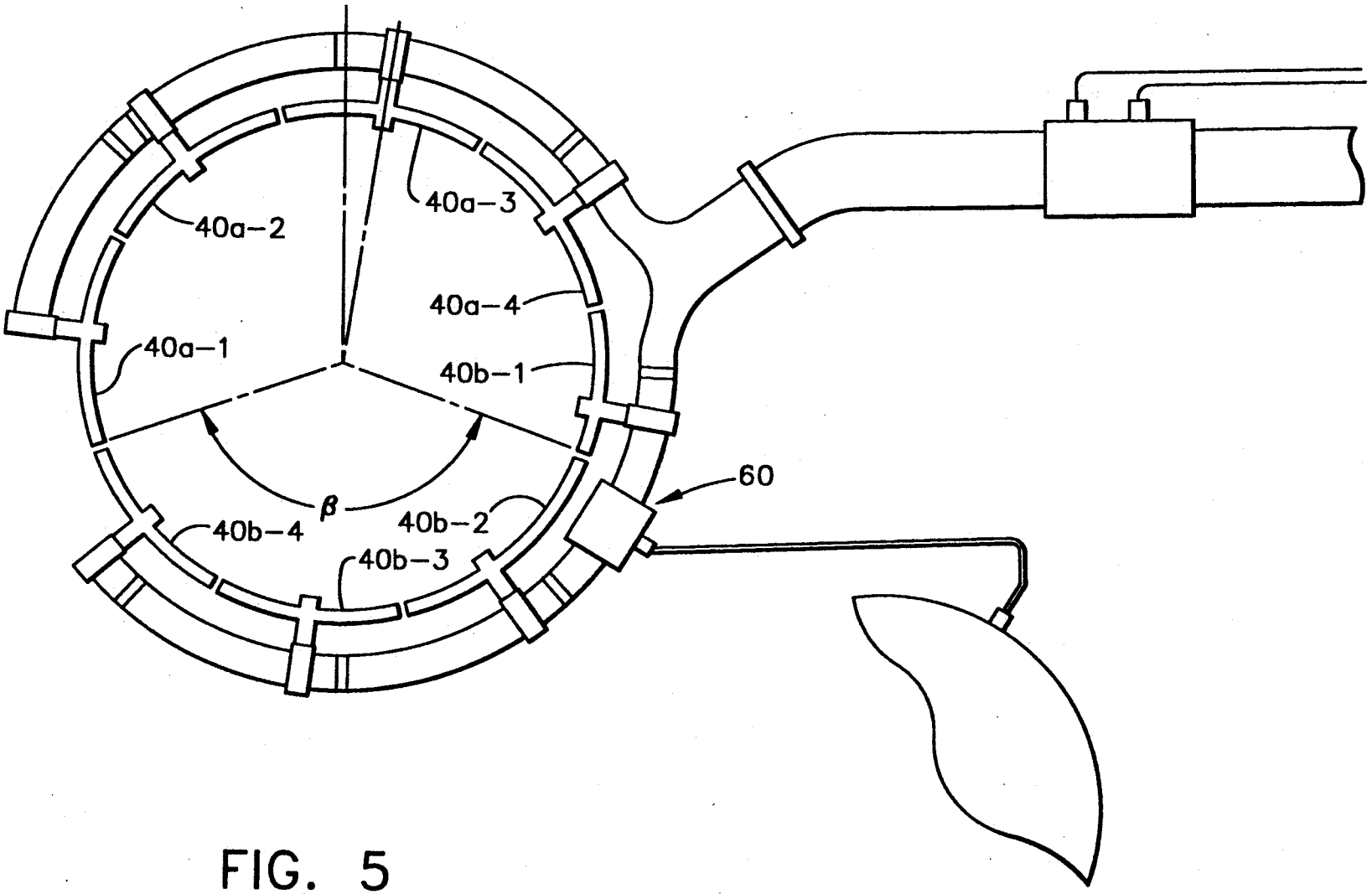
FIG. 5 is an illustration of a schematic view of an alternate embodiment of a clearance control system in accordance with the present invention.

Illustrated in FIG. 1 is a gas turbine engine 10 comprising a fan section 12, compressor 14, combustor 16, high pressure turbine 18 and low pressure turbine 20, all in serial, axial flow relationship and disposed coaxially about the engine centerline 22.

Referring now to FIG. 2, the high pressure turbine 18 and associated structures are shown in greater detail with the present invention incorporated therein. The high pressure turbine 18 comprises a single-stage row of rotor blades 24 disposed in the hot gas stream flowpath 26 and circumscribed by an annular shroud 28. Hot turbine gases in the hot gas stream flowpath 26 are directed against rotor blades 24 so that the inertial force of the gases causes the blades 24 to rotate.

The efficiency of this transfer of inertial force is a major factor in the overall efficiency of the engine. One means of improving the efficiency of this transfer is to decrease any leakage of hot gases between the tips of the blades 24 and the annular stationary shroud 28.

In the embodiment of the invention shown in FIG. 2, the rotor blade clearance is decreased by radially expanding and contracting the shroud support ring structure 11 to match the radial expansion and contraction of rotor blades 24.

A segmented annular shroud 28 is preferably made of a number of annular sectors attached to an annular ring 30 of shroud support 11. Annular ring 30 has at its rearward end a radially inwardly extending collar 32 which is attached to the annular shroud 28 by way of the annular segmented bracket 34. The forward side of the ring 30 is attached to the shroud 28 by way of the annular segmented bracket 36. Axial support for the annular segmented bracket 36 is derived by axially extending a segmented ring 38 in a rearward and radially outward direction to mate with the collar 32.

Located radially outwardly from the annular ring 30 is at least one separate and distinct hot air impingement manifold 40 which form an annular plenum 42. In communication with manifolds 40 is a plurality of air bleed-off conduits 44 which carry hot air from the intermediate stages of the compressor 14 (FIG. 1) to plenums 42.

Referring now more specifically to the annular ring 30, the ring 30 is shown to include radially outwardly extending flanges 46 and 48 which project towards plenums 42, but not to the extent of contact with manifolds 40. Both ring 30 and flanges 46 and 48 are composed of a material having a relatively high coefficient of thermal expansion. Hot bleed air in plenums 42 is directed through holes 50 in manifolds 40 thereby impinging on ring 30 and flanges 46 and 48 to cause radial expansion and/or contraction. By regulating the amount and temperature of the air entering plenums 42, the amount of expansion and/or contraction of flanges 46 and 48 and ring 30 can be controlled. The controlled radial expansion and/or contraction of flanges 46 and 48 and ring 30 during appropriate stages of engine operation permit close matching of the radial growth or shrinkage of shroud 28 to the radial growth or shrinkage of the rotor 52 thereby maintaining an allowable clearance between them.

In a preferred embodiment of the invention, as illustrated in FIG. 4, two separate and distinct hot air impingement manifolds **40*a* and 40*b* are shown surrounding flanges 46 and 48 and ring 30. Impingement manifolds 40*a* and 40*b* are provided with upper control valve means 54*a* and lower control valve means 54*b* effective for regulating hot airflow into the manifolds 40*a* and 40*b*. During an aircraft maneuver, large loads develop that tend to cause the center of rotation of the rotor 52 to become eccentric to the engine centerline 22. By controlling the amount of hot air and by directing it into a selected manifold or manifolds, the clearance between the blade tips 25 and the surrounding shroud 28 can be regulated for various flight and load conditions. For example, as shown in FIG. 4, upper air control valve means 54*a* can be closed while lower air control valve means 54*b* can be open permitting hot gas to enter the lower manifold 40*b* but not the upper manifold 40*a*. This results in hot air impinging and heating the lower part of ring 30 and flanges 46 and 48 (FIG. 2), while the upper part of the ring and flanges would remain relatively cool. The uneven heating will result in expanding the lower portion of shroud 28 to a greater extent than the upper portion of the shroud 28, thereby producing ovalization of the shroud as shown. This ovalization results in minimizing the clearance effects of eccentric loadings by allowing the shroud to conform to high load induced nonconcentricities of the rotor. However, unlike the prior art method of shroud grinding, the invention allows the shroud to return to a more desirable low maneuver leakage configuration during low load conditions. In this way, the invention will provide a gas turbine engine capable of operating over a variety of engine and aircraft maneuvers without attendant interference between the rotor 52 and the surrounding shroud 28**.

An advanced form of the present invention is shown in FIG. 5 wherein the impingement manifold **40*a* and 40*b* have been segmented into a plurality of manifold segments 40*a*-1, 40*a*-2, 40*a*-3, 40*a*-4, 40*a*-5, 40*b*-1, 40*b*-2, and 40*b*-3. In this embodiment, the stator shroud 28 is ground eccentrically, as shown in FIG. 3, in order to maintain nearly uniform clearances at high power conditions. At lower power conditions, the rotor and stator centers are more closely aligned resulting in a more open clearance as shown in FIG. 3. Uniform circumferential clearances are restored at low power conditions by preferentially cooling the lower arc portion of flanges 46 and 48 by means of preferential cooling impingement manifold segments 40*a*-1, 40*a*-2, 40*a*-3, 40*a*-4, 40*a*-5, 40*b*-1, 40*b*-2, and 40*b*-3. In particular, the manifold segments 40*b*-1, 40*b*-2, and 40*b*-3, have substantially more impingement holes than segments 40*a*-1, 40*a*-2, 40*a*-3, 40*a*-4, and 40*a*-5, thus providing additional cooling over the lower portion of the flanges 46 and 48. The additional cooling of the lower arc of flanges 46 and 48 results in an ovalization of the shrouds 28** yielding more uniform clearances at low power conditions.

A further refinement of the invention is that a valve 60 is provided to control the airflow and more particularly divert air from the lower manifold to restrict airflow to the lower manifold segments **40*b*-1, 40*b*-2, and 40*b*-3 at high power conditions. The diversion of air from the lower manifold segments causes the manifolds to create a more nearly uniform circumferential temperature distribution in flanges 46 and 48, thus producing more uniform tip clearance at the high power conditions. This refinement is of particular value in reducing transient exhaust gas temperature during an acceleration to high power conditions. The valve 60** preferably can be operated by either the engine control unit (ECU) or a mechanical switch governed by engine pressure ratios.

Another feature of the present invention is that by using additional manifolds and airflow and temperature control valve means, shroud portions which might experience blade rubs can be eliminated without increasing overall blade clearances. For example, by using a separate manifold and hot air control valve means, one can expand an individual shroud portion while easily maintaining the same blade-shroud clearance along the remaining portions of the shroud.

It will be clear to those skilled in the art that the present invention is not limited to the specific embodiments described and illustrated herein. Rather, it applies equally to any gas turbine engine clearance control system which uses heating and cooling to expand or contract shrouded surfaces. As an example, an electrical zone heating system could also be used.

It will be understood that the dimensions and proportional and structural relationships shown in the drawings are by way of example only, and these illustrations are not to be taken as the actual dimensions or proportional structural relationships used in the clearance control system of the present invention.

Numerous modifications, variations, and full and partial equivalents can now be undertaken without departing from the invention as limited only by the spirit and scope of the appended claims.

What is desired to be secured by Letters of Patent of the United States is the following:

1. In a gas turbine engine, a clearance control system comprising:

a) a rotor;

b) an annular shroud surrounding said rotor;

c) a shroud support structure attached to said shroud;

d) means for generating a non-uniform circumferential temperature distribution in the shroud support structure to produce ovalization of said shroud during selected operating conditions of aid gas turbine engine, wherein said generating means further comprises:

i) an upper circumferentially extending air impingement manifold surrounding an upper portion of said shroud support structure for impinging compressed air on said upper portion of said shroud support structure;

ii) a lower circumferentially extending air impingement manifold surrounding a lower portion of said shroud support structure for impinging compressed air on said lower portion of said shroud support structure, said lower manifold being separate from said upper manifold;

iii) an upper control valve for controlling a temperature and a flow rate of a first airflow supplied to said upper manifold; and iv) a lower control valve for controlling a temperature and a flow rate of a second airflow supplied to said lower manifold, wherein said upper control valve and said lower control valve are separately controlled.

2. In a gas turbine engine, a clearance control system comprising:

a) a rotor having a plurality of blades and a center of rotation about an engine centerline;

b) a shroud radially surrounding said blades and concentric with said rotor;

c) a shroud support structure attached to said shroud;

d) means for varying a circumferential temperature distribution of said shroud support structure to conform to high load induced nonconcentricities of said rotor, wherein said varying means further comprises:

i) an upper circumferentially extending air impingement manifold surrounding an upper portion of said shroud support structure for impinging compressed air on said upper portion of said shroud support structure;

ii) a lower circumferentially extending air impingement manifold surrounding a lower portion of said shroud support structure for impinging compressed air on said lower portion of said shroud support structure, said lower manifold being separate from said upper manifold;

iii) an upper control valve for controlling a temperature and a flow rate of a first airflow supplied to said upper manifold; and iv) a lower control valve for controlling a temperature and a flow rate of a second airflow supplied to said lower manifold, wherein said upper control valve and said lower control valve are separately controlled.

3. A clearance control system according to claim 2, wherein:

a) the shroud support structure includes an annular ring having a plurality of flanges; and b) each of said impingement manifolds surrounds said flanges.

4. A clearance control system according to claim 3, wherein said annular ring and said flanges are composed of a material having a relatively high coefficient of thermal expansion.

5. A clearance control system according to claim 3, wherein air impinges on said ring and on said flanges to regulate an annular clearance between said shroud and said blades.

6. A clearance control system according to claim 5, wherein said plurality of flanges includes a forward flange and an aft flange, wherein each of said flanges extends in a radially outward direction.

7. In a gas turbine engine, a clearance control system comprising:

a) a rotor including a plurality of blades, each of said blades having a radially outward tip;

b) an annular shroud surrounding said rotor, wherein a radially inward and radially facing surface of said shroud is eccentrically ground to conform to nonconcentricities of aid rotor during high power conditions of said gas turbine engine;

c) a shroud support structure attached to said shroud;

d) means for preferentially cooling a lower portion of said shroud support structure during low power conditions of said gas turbine engine to enhance uniformity of an annular clearance between said shroud radially inward surface and said blade tips, said cooling means comprising a plurality of circumferentially extending lower air manifolds for impinging air on a lower portion of said shroud support structure; and e) means for diverting air from said plurality of lower air manifolds during said high power conditions of said gas turbine engine to enhance uniformity of said annular clearance and to reduce a transient exhaust gas temperature of said gas turbine engine during an acceleration of said gas turbine engine to said high power conditions.

8. A clearance control system according to claim 7, further comprising a plurality of circumferentially extending upper air manifolds for impinging air on an upper portion of said shroud support structure, wherein said lower air manifolds include a plurality of impingement holes which are substantially greater than a plurality of impingement hole in said upper air manifolds.

9. A clearance control system according to claim 8, wherein said diverting means comprises a valve.

* * * * *